US006806831B2

(12) United States Patent
Johansson et al.

(10) Patent No.: US 6,806,831 B2
(45) Date of Patent: Oct. 19, 2004

(54) STACKED PATCH ANTENNA

(75) Inventors: Martin Johansson, Möldnal (SE); Stefan Lindgren, Göteborg (SE); Anna Grincwajg, Frölunda (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 228 days.

(21) Appl. No.: 10/086,195

(22) Filed: Mar. 1, 2002

(65) Prior Publication Data

US 2002/0175871 A1 Nov. 28, 2002

Related U.S. Application Data

(63) Continuation of application No. PCT/SE00/01679, filed on Sep. 1, 2000.

(30) Foreign Application Priority Data

Sep. 3, 1999 (SE) ..... 9903115

(51) Int. Cl.[7] ..... H01Q 1/38
(52) U.S. Cl. ..... 343/700 MS
(58) Field of Search ..... 343/700 MS, 829, 343/846, 767, 770

(56) References Cited

U.S. PATENT DOCUMENTS 4,660,048 A 4/1987 Doyle
5,539,420 A 7/1996 Dusseux et al.
5,627,550 A 5/1997 Sanad
5,703,601 A * 12/1997 Nalbandian et al. . 343/700 MS
6,236,367 B1 * 5/2001 Du Toit et al. ..... 343/700 MS
6,304,220 B1 * 10/2001 Herve et al. ..... 343/700 MS
6,323,810 B1 * 11/2001 Poilasne et al. ..... 343/700 MS
6,466,170 B2 * 10/2002 Zhou ..... 343/700 MS

FOREIGN PATENT DOCUMENTS

EP 0 795 926 A2 9/1997

* cited by examiner

*Primary Examiner*—Tho Phan
(74) *Attorney, Agent, or Firm*—Nixon & Vanderhye P.C.

(57) ABSTRACT

A stacked patch antenna comprising two metallic patches (210, 240) stacked on top of each other. The middle patch (210) comprises at least two conductors (224, 234) at or close to its edge (212), which conductors are intended to be connected to a ground plane (200) to thereby ground the patch in two places. The top patch (240) comprises at least two conductors (254, 264) at or close to its edge (242) which electrically interconnect the two patches. The middle patch is fed at a feed area (219) which is at least proximate its geometric center. The middle patch further comprises at least two apertures (220, 230) completely within its circumference (212), i.e. each aperture having a respective unbroken circumference (232, 242). Thereby enabling radiation from slots (214, 216, 244, 246) defined by the edge of the top patch and the edge of the middle patch and defined by the edge of the middle patch and the ground plane.

32 Claims, 5 Drawing Sheets

STACKED PATCH ANTENNA

This application is a continuation of PCT/SE00/01679 filed Sep. 1, 2000.

TECHNICAL FIELD

The invention concerns antennas, specifically small stacked patch antennas.

BACKGROUND

The size of mobile wireless terminals is decreasing as digital and analog components become increasingly integrated and miniaturized. Apart from user interface aspects, the main limiting factor on further size reductions are the antennas. The antennas are now a dominating factor in the visual appearance of many mobile devices. From an esthetic point of view it would be desirable to have antennas that are small. Further, manufacturing costs can usually be reduced with smaller antennas.

Wireless local-area network (LAN) solutions for office use are rapidly becoming a prominent competitor to traditional wireline networks. A major advantage of wireless LANs is the mobility they offer. A computer can be connected to a wireless LAN from anywhere within the LAN's coverage area. The antennas for the mobile terminals of the wireless LANs are normally intended for installation on a PC-card, which puts constraints on the allowable antenna size. However, the dimensions of antennas are wavelength dependent. Additionally an antenna's bandwidth and radiation efficiency are limited by the effective volume, in terms of wavelengths, that the antenna occupies.

Another constraint put on antennas is their radiation pattern. Wireless LAN antennas mounted on, for example, a PC-card should be small and radiate primarily in the horizontal plane. Indoor wave propagation tends to be confined to incidence angles within a narrow angular interval centered around the horizon. The antenna should also have an omni-directional radiation pattern, i.e. the radiation pattern should be substantially independent of the azimuthal angle, in order to be able to register the various wave components of a typical multipath propagation channel common in indoor environments. Thus, a wireless LAN antenna should be wideband, efficient and substantially omni-directional. Further, such an antenna should make an optimum use of its volume in order to fit into an alloted space in a respective device. Wireless LAN antennas intended to be mounted on a PC-card (direction of mounting in relation to computer orientation when in use should be taken into account), should therefore be planar and low-profile with a negligible thickness.

Additionally a wireless LAN antenna for indoor use should, apart from an omnidirectional radiation pattern with an essentailly constant radiation pattern in the azimuthal (horizontal) direction, preferably also have a null-depth, or a near null-depth, in the broadside (vertical) direction. A null-depth, or near null-depth in the broadside direction is important to enable different wireless LANs on different floors to co-exist with as little cross interference as possible.

A variety of small low profile antennas have been proposed. Examples include everything from antennas based on modifications of the traditional monopole antenna to elaborate optimized antenna schemes involving multi-layered structures with meandering lines, ceramic materials, and various types of impedence matching schemes. Most types of low profile antennas with wide bandwidths have semi-isotropic radiation patterns with maximum radiation, or at least significant radiation levels, in the broadside, i.e. vertical, direction. One type of antenna that addresses some of the above mentioned constraints is the bent stacked slot antenna (BSSA). The BSSA antenna achieves a relatively wide bandwidth and small size and makes use of a center strip of a middle patch as an integrated impedance matching unit. An example of such an antenna is described in the European patent application EP 795926. However, a disadvantage with the BSSA type of antenna can in some applications be considered to be the inherent azimuthal gain variations and relatively narrow bandwidth, i.e. there is a need for a more omni-directional antenna with a wider bandwidth.

SUMMARY

An object of the invention is to define a low-profile antenna which provides a high efficiency, good omni-directionality and a wide bandwidth.

Another object of the invention is to define a low-cost low profile antenna which is suitable to be mounted on a PC-card.

A further object of the invention is to define a low profile antenna which when mounted horizontally provides a substantially omni-directional radiation pattern in the azimuthal direction and at least a near null-depth in the broadside direction.

The aforementioned objects are achieved according to the invention by a stacked patch antenna. The stacked patch antenna is intended to be mounted on a ground plane. The antenna comprises two stacked metallic patches. The patches are stacked on top of each other. The patch to be mounted closest to the ground plane, the middle patch, comprises at least two conductors at or close to its edge which conductors are intended to be connected to the ground plane to thereby ground the patch in two zero potential areas. The patch to be mounted furthest away from the ground plane, the top patch, comprises at least two conductors at: or close to its edge which electrically interconnect the two patches. The conductors electrically interconnecting the patches should preferably be connected to the middle patch at least proximate the respective zero potential areas of the middle patch. The conductors preferably also provide structural strength to the antenna and provide mounting means and support for the patches. The middle patch is fed at a feed area which is at least proximate the geometric center of the middle patch. The middle patch further comprises at least two apertures completely within the circumference of the middle patch. The apertures do not divide the middle patch into two or more physically and/or electrically separated parts, i.e. the middle patch is in one piece. Preferably the apertures are placed in such a way that at least two paths are provided from each place which is grounded on the middle patch to the feed area, i.e. each aperture blocks a direct line from the feed area to a respective place which is grounded. There is always at least one physical/electrical connection between the feed area and each zero potential area of the middle patch. Thereby enabling radiation from a slot defined by the edge of the top patch and the edge of the middle patch and a slot defined by the edge of the middle patch and the ground plane.

The aforementioned objects are also achieved according to the invention by a stacked patch antenna comprising two metallic patches stacked on top of each other. The middle patch comprises at least two conductors at or close to its edge, which conductors are intended to be connected to a ground plane to thereby ground the patch in two places. The top patch comprises at least two conductors at or close to its edge which electrically interconnect the two patches. The middle patch is fed at a feed area which is at least proximate Its geometric center. The middle patch further comprises at least two apertures completely within its circumference, i.e. each aperture having a respective unbroken circumference. Thereby enabling radiation from slots defined by the edge of the top patch and the edge of the middle patch and defined by the edge of the middle patch and the ground plane.

The aforementioned objects are also achieved according to the invention by a low profile antenna structure. The antenna structure comprises a first metallic patch and a second metallic patch stacked over a ground plane. The first patch comprises a circumference along a patch edge of the first patch. The second patch comprises a circumference along a patch edge of the second patch. The first patch is arranged between the ground plane and the second patch. The first patch is grounded at at least a first zero potential area by electrical connection with the ground plane and a second zero potential area by electrical connection with the ground plane. The first patch is further fed at a single feed area. The second patch is electrically interconnected to the first patch. According to the invention the first patch comprises at least a first aperture and a second aperture located completely within the circumference of the first patch, i.e a current can flow on the first patch completely around each aperture and a current can flow on the first patch from the feed area to each zero potential area. The presence of the apertures force current, propagating from the feed area to the first zero potential area and the second zero potential area, toward the patch edge of the first patch. By forcing the current to flow close to the edge there can be radiation from slots defined by the edge of the first patch and the edge of the second patch and the ground plane. The slots go around the antenna almost completely and therefore a substantially omni-directional radiation pattern is provided.

The aforementioned objects are also achieved according to the invention by a low profile antenna structure. The antenna structure comprises a first metallic patch and a second metallic patch stacked over the first patch. The patches are intended to be mounted over a ground plane. The first patch comprises a circumference along a patch edge of the first patch. The second patch comprises a circumference along a patch edge of the second patch. The first patch is arranged between the ground plane and the second patch. The first patch comprises a first zero potential area by connection with the ground plane and a second zero potential area by connection with the ground plane. The second patch is electrically interconnected to the first patch. The antenna is fed at a single feed area comprised on the first patch. According to the invention the first patch comprises at least a first aperture and a second aperture located completely within the circumference of the first patch, i.e. the first patch comprises two apertures with edges that do not even touch the edge of the first patch. By providing these apertures, current, propagating from the feed area to the first zero potential area and the second zero potential area, is forced toward the patch edge of the first patch to. By forcing the current to take these paths radiation is enabled from slots defined by the edge of the first patch and the edge of the second patch and the ground plane.

Advantageously the first aperture and the second aperture are located on the first patch in such a way that current propagating from the feed area to the first zero potential area propagates in two different paths around the first aperture and that current propagating from the feed area to the second zero potential area propagates in two different paths around the second aperture. Preferably the first aperture is located between the feed area and the first zero potential area, and the second aperture is preferably located between the feed area and the second zero potential area. Advantageously the second patch is electrically interconnected to the first patch at at least the first zero potential area and the second zero potential area.

Preferably, to ensure that the current propagates where desired, the first aperture and the second aperture each have an extension which is substantially perpendicular to a line between the first zero potential area and the second zero potential area, i.e. the apertures are longer than they are wide In certain embodiments there is a symmetry of the first patch about a line between the first zero potential area and the second zero potential area. In other embodiments, alone or in combination, there is a symmetry of the first patch about a line perpendicular to a line between the first zero potential area and the second zero potential area. Other embodiments are more or less asymmetric.

In some embodiments the second patch comprises no openings within its circumference. In other embodiments the second patch comprises at least one opening within its circumference. In further embodiments the second patch is electrically split into two halves along a line which is substantially perpendicular to a line between the first zero potential area and the second zero potential area.

Preferably the second patch at least covers the first aperture and the second aperture of the first patch.

In some embodiments the first patch comprises further apertures. In some embodiments the antenna structure comprises the ground plane. Then, advantageously the ground plane is substantially of the same size as the first patch and the second patch. In some embodiments the first patch and the second patch are substantially of the same size. In certain applications the first patch, in addition to the first aperture and the second aperture, advantageously comprises further apertures.

In some embodiments the electrical connections from the first patch to the ground plane and the electrical interconnections between the first patch and the second patch, in addition to providing the antenna structure with electrical connections also provides the antenna with mechanical support giving the antenna a self supporting structure. In other embodiments the first patch is supported by a first dielectric and the second patch is supported by a second dielectric, the first dielectric and the second dielectric further providing the antenna with mechanical support giving the antenna a self supporting structure. In other embodiments comprising the ground plane it can be advantageous that the first patch is supported by a first dielectric and that the second patch is between the first dielectric and a second dielectric and that the ground plane is supported by the second dielectric, the first dielectric and the second dielectric further providing the antenna with mechanical support giving the antenna a self supporting structure.

The antenna structure according to the invention may at the single feed area be probe fed at one point, thereby attaining a shielded feed probe. The single feed area can then also further comprise inductive feed matching. Optionally the antenna structure may at the single feed area be fed by an aperture coupling. Alternatively the single feed area may be probe fed at a plurality of points. The plurality of points can advantageously be placed in the feed area along a limited line that if extended would pass through the first zero potential area and the second zero potential area. Preferably the plurality of points are placed in the feed area symmetrically about a line that passes through the first zero potential area and the second zero potential area.

The different additional enhancements of the antenna structure according to the invention can be combined in any desired manner as long as no conflicting features are combined.

The aforementioned objects are also achieved according to the invention by a device comprising wireless communication means, which device comprises an antenna according to any above described antenna structure according to the invention.

The aforementioned objects are also achieved according to the invention by a wireless or wireless mobile terminal which comprises an antenna according to any above described antenna structure according to the invention for wireless communication.

The aforementioned objects are also achieved according to the invention by a personal computer card suitable for insertion into an electronic device, which card comprises an antenna according to any above described antenna structure according to the invention The aforementioned objects are also achieved according to the invention by a wireless local area network system comprising a base station and a plurality of terminals which are in wireless communication with the base station, where at least one terminal comprises either directly, i.e. permanently mounted in the terminal, or indirectly, i.e. removably mounted in the wireless terminal, an antenna according to any above described antenna structure according to the invention.

By providing a low-profile stacked patch antenna according to the invention a plurality of advantages over prior art antennas are obtained. Primary purposes of the invention are to provide a substantially omni-directional antenna with a low-profile that is suitable for mounting on a PC-card, which is still efficient and has a wide bandwidth, for use in a, for example, wireless LAN. Other advantages of this invention will become apparent from the detailed description.

BRIEF DESCRIPTION OF THE DRAWINGS

The invention will now be described in more detail for explanatory, and in no sense limiting, purposes, with reference to the following figures, in which.

DETAILED DESCRIPTION

In order to clarify the method and device according to the invention, some examples of its use will now be described in connection with FIGS. 1 to 7.

Figure 1:
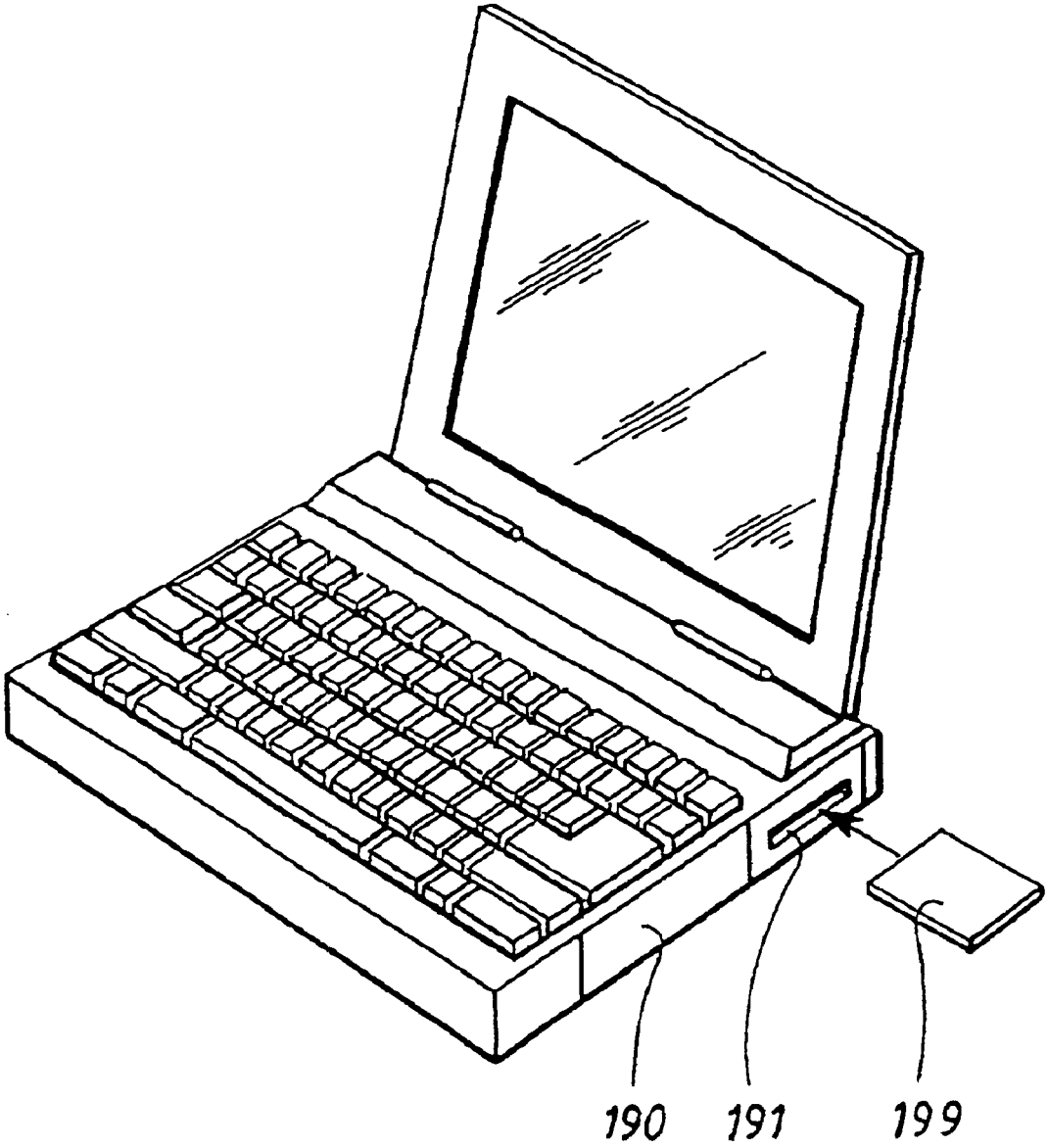
FIG. 1 shows a wireless mobile terminal in the form of a personal computer, comprising either directly or indirectly an antenna according to the invention.

FIG. 1 shows a wireless mobile terminal in the form of a personal computer 190. The personal computer can either comprise communication means permanently mounted within the computer 190, or allow a communication card 199 to be inserted by means of a slot/mounting means 191 into the computer. A low profile stacked patch antenna according to the invention is suitable to be mounted either directly into the computer 190, or be made accessible indirectly to the computer by being mounted on a PC-card 199. The wireless terminal 190 can, for example, be connected to a wireless local area network via the communications means.

Figure 2:
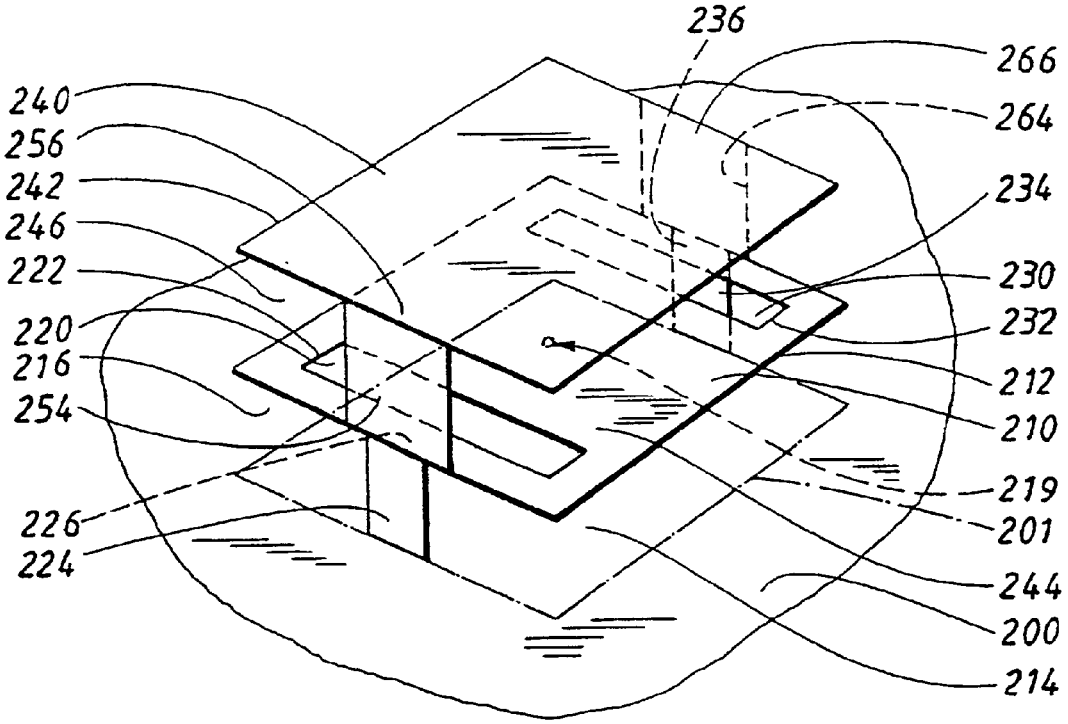
FIG. 2 shows a small stacked patch antenna according to the invention.

FIG. 2 shows a small stacked patch antenna according to the invention. The antenna comprises two stacked patches 210, 240 which are intended to be mounted above a ground plane 200. The ground plane 200 can be comprised in the antenna, in which case the ground plane 200 is of the approximate same size 201 as the patches 210, 240, specifically the first/middle patch 210. The patches 210, 240, will in many embodiments have at least the same approximate shapes and size limits, but they 210, 240 do not have to be of the same size or shape. One of the functions of the second/top patch 240 is to cover, along a normal vector to the ground plane, at least two apertures 220, 230 on the middle patch 210, in order to prevent the apertures 220, 230 from radiating. The patches 210, 240 are mounted apart from each other and apart from the ground plane 200 in such a way that radiating slots 214, 216, 244, 246 are formed. The radiating slots 214, 216, 244, 246 are defined as the openings that are formed between the edge/circumference 242 of the top patch 240 and the edge/circumference 212 of the middle patch 210, and also the openings that are formed between the edge/circumference 212 of the middle patch 210 and the ground plane 200 along a projection 201 of the middle patch 210 onto the ground plane 200. The slots 214, 216, 244, 246 are made to radiate by forcing a current that propagates from a feed point/area 219 to at least two zero potential areas 226, 236, toward the circumference 212 of the middle patch 210. The current is forced toward the circumference 212 by means of the apertures 220, 230. The apertures 220, 230 are thus positioned on the middle patch 210 so that they hinder/block the current from propagating directly in a straight line to the two zero potential areas 226, 236. The apertures 220, 230 are located completely within the circumference 212 of the middle patch 210 so that current can pass around the apertures 220, 230, i.e. the circumference 212 of the middle patch does not touch or intersect a circumference/edge 222, 232 of the apertures 220, 230. The two zero potential areas 226, 236 are formed by grounding the middle patch 210 on or proximate to the circumference 212 by means of electrical connections/conductors 224, 234. The conductors 224, 234 are placed so that there is an aperture 220, 230 between each zero potential area 226, 236 that is formed by the grounding, and the feeding area 219. The top patch 240 is also grounded by means of electrical connections/conductors 254, 264 to create zero potential areas 256, 266 at or proximate the circumference 242 on the top patch 240. The conductors 254, 264 are preferably connected directly to or proximate a corresponding zero potential area 226, 236 of the middle patch 210.

The size of the conductors 254, 264 between the top patch 240 and the middle patch 210 will influence the front slot 244 and the back slot 246 between the top patch 240 and the middle patch 210. The size of the conductors 224, 234 between the middle patch 210 and the ground plane 200 will influence the front slot 214 and the back slot 216 between the middle patch 210 and the ground plane 200. This gives the antenna structure according to the invention four fundamental degrees of freedom. The antenna can thus be designed to have up to four separate well matched bands, a single continuous frequency band with a very large bandwidth, or in the case of a completely symmetrical antenna structure one well matched substantially omnidirectional large bandwidth frequency band.

The patches 210, 240 can be supported by dielectric carriers or as shown in the figure be mechanically supported by the conductors 224, 234, 254, 264.

Figure 3:
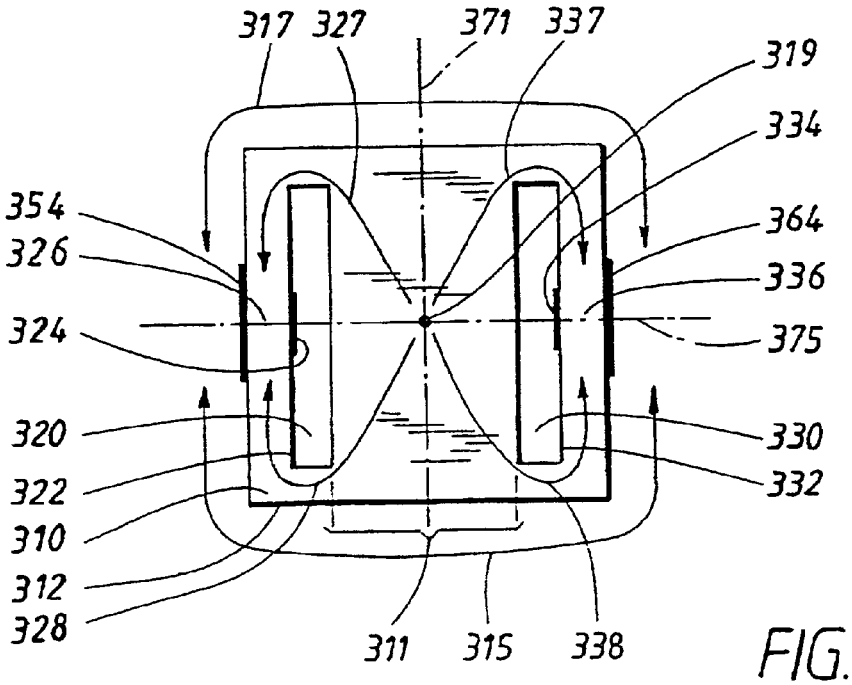
FIG. 3 shows a middle patch of an antenna according to the invention.

FIG. 3 shows a middle patch 310 of an antenna according to the invention. The figure shows the middle patch 310 with a first aperture 320 with Its corresponding edge/circumference 322, a second aperture 330 with its corresponding edge circumference 332, a feed point/area 319, a first zero potential area 326, a second zero potential area 336, a connection place 324 for a first conductor to Ea ground plane, a connection place 334 for a second conductor to a ground plane, a connection place 354 for a first conductor to a top patch, a connection place 364 for a second conductor to a top patch, and an edge/circumference 312 of the middle patch 310. The figure further shows a first symmetry line 371, a second symmetry line 375, a first current path 327 around the first aperture 320, a second current path 328 around the first aperture 320, a first current path 337 around the second aperture 330, a second current path around the second aperture 330, a front slot position 315 between the middle patch 310 and a ground plane, a back slot position 317 between the middle patch 310 and a ground plane, and a middle patch strip section 311. In this example the zero potential areas 326, 336 are located between the respective connection places 324, 334 for conductors to a ground plane and corresponding connection places 354, 364 for conductors to a top patch.

As can be seen in the figure, the apertures 320, 330 block a possible straight line current path from the feed area 319 to the respective zero potential areas 326, 336. The apertures 320, 330 force the formation of two different current paths 327, 328, 337, 338 to each zero potential area 326, 336. The current paths 327, 328, 337, 338 come close to the circumference 312 of the patch 310 due to the apertures 320, 330 which extend in a direction parallel to the first symmetry line 371 which is perpendicular to the second symmetry line 375 which goes through at least one zero potential area 326, 336 and the feed area 319. Due to the currents 327, 328, 337, 338 close to the circumference 312, the slots become excited and will radiate the front and back slot positions 315, 317.

The exact placement of the feed area 319 will depend on the specific embodiment and in connection with the strip section 311 will provide an impedance match to the radiation resistance experienced at the patch circumference 312.

The patch 310 can be symmetrical about either one or both of the symmetry lines 371, 375. A completely symmetrical patch can provide nearly monopoly type radiation characteristics as to omni directionality in the horizontal plane.

Figure 4:
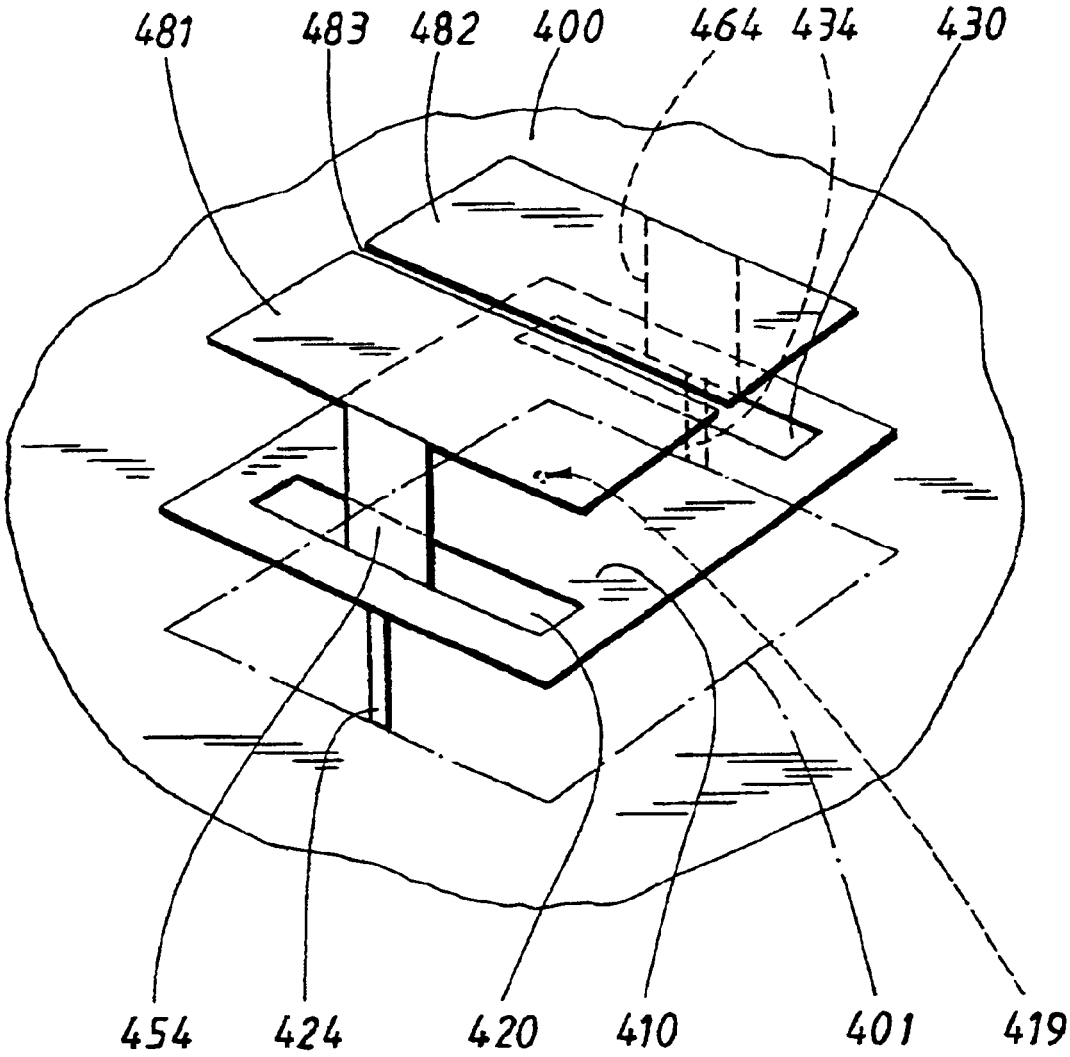
FIG. 4 shows a second embodiment of a small stacked patch antenna according to the invention.

FIG. 4 shows a second embodiment of a small stacked patch antenna according to the invention. In this embodiment the top patch is split into two halves 481, 482 with an electrical disconnection line 483. This does not change the function of the top patch. Further, the top patch halves 481, 482 are somewhat smaller than the middle patch 410, but still covering the apertures 420, 430. The conductors 424, 434, 454, 464 for grounding the top patch halves 481, 482 and the middle patch 410 to ground 400 are of different dimensions and are connected to their respective patch 410, 481. 482 or ground plane 400 in alternative places than those shown in FIG. 2. The projection outline 401 of the middle patch 410 onto the ground plane 400 is also shown to better see the connections 424, 434 to the ground plane 400 and also to show the size of a suitable minimum ground plane. A feed point/area 419 is also shown.

FIGS. 5A to 5D show different embodiments of a middle patch 510 of antennas according to the invention, All the middle patch 510 examples show a feed point/area 519, a first aperture 520 with a corresponding edge/circumference 522, a second aperture 530 with a corresponding edge/circumference 532, a first zero potential area 526 with a corresponding grounding connector/conductor attachment 524, a second zero potential area 536 with a corresponding grounding connector/conductor attachment 534. As can be seen an edge/circumference 512 of each middle patch 510 is completely different in the shown examples.

Figure 5A:
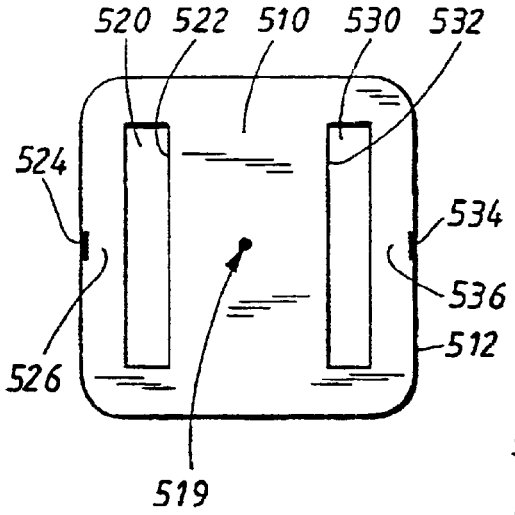
FIGS. 5A–D show different embodiments of a middle patch of antennas according to the invention.
Figure 5B:
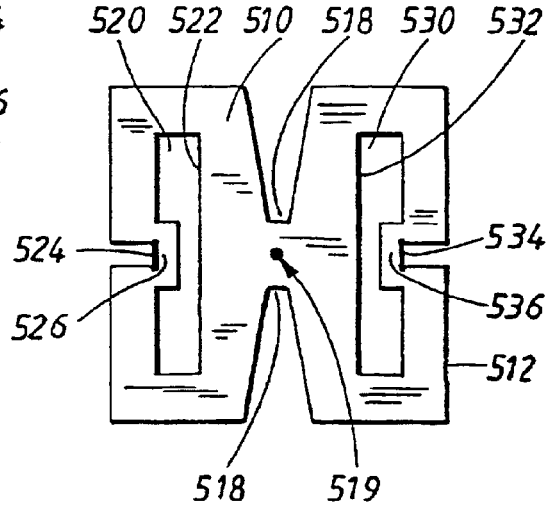
Figure 5C:
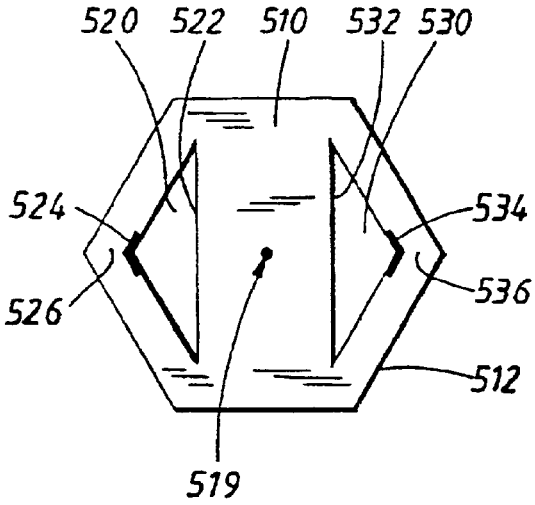
Figure 5D:
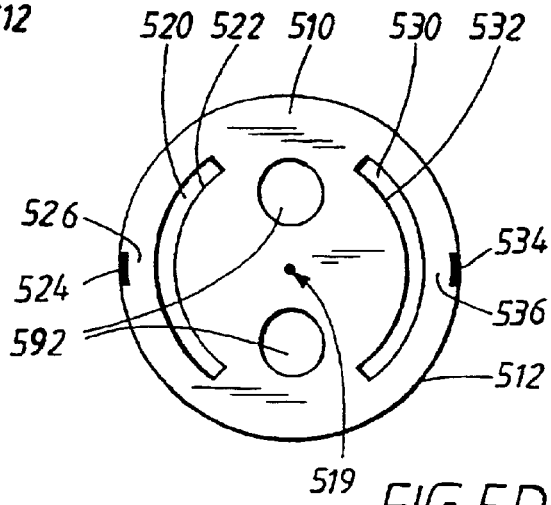

FIG. 5A shows a middle patch 510 with a rectangular/squarish type circumference 512 with rounded corners and rectangular apertures 520, 530. FIG. 5B shows a middle patch 510 with a indented squarish type circumference 512 and rectangular apertures 520, 530 with indentations. The indentations 518 of the circumference 512 of the middle patch 510 towards the feed point 519 will force an antenna with this middle patch 510 to have four radiation centres instead of just the two that were indicated and described in relation to FIG. 3. FIG. 5C shows a middle patch 510 with a hexagon circumference 512 and triangular apertures 520, 530. FIG. 5D shows a middle patch 510 with a circular circumference 512 and circular sector type apertures 520, 530. The middle patch 510 according to FIG. 5D also shows two additional apertures 592, which in this example are circular. These examples are shown just to indicate the huge variety of different embodiments an antenna structure according to the invention can take.

Figure 6:
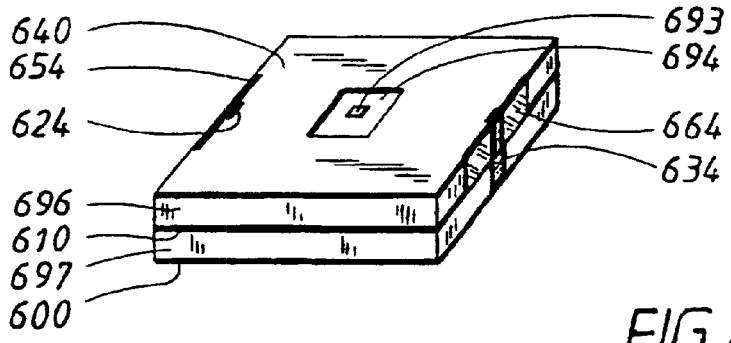
FIG. 6 shows a third embodiment of a small stacked patch antenna according to the invention.

FIG. 6 shows a third embodiment of a small stacked patch antenna according to the invention which is completely self contained and self supported. The small stacked patch antenna according to FIG. 6 shows a ground plane 600, a first/middle patch 610, a second/top patch 640, a first dielectric 696 between the top 694 and the middle patch 610, a second dielectric between 697 the middle patch 610 and the ground plane 600, and an opening 694 in the top patch 640 for a feed conductor/via 693 that extends all the way from the ground plane 600 to the level of the top patch 640. FIG. 6 further shows a first conductor/via 624 to the ground plane 600 grounding the middle patch 610, a second conductor/via 634 to the ground plane 600 grounding the middle patch 610, a first conductor/via 654 to the middle patch 610 from the top patch 640. and a second conductor/via 664 to the middle patch 610 from the top patch 640.

Preferably, as is indicated in the figure, the conductors/vias 624, 634 that ground the middle patch 610, extend from the top patch 640 through the middle patch 610 all the way to the ground plane 600. To be noted is that the feed conductor/via 693 also extends through all of the layers in this particular embodiment.

By integrating the ground plane 600 into the antenna itself, it is possible to attain an antenna with very small tolerances between all of the layers of the antenna. It is then also possible by having the ground plane 600 integrated, to place the antenna where there is no ground plane, e.g. vertically out from a printed circuit board.

The antenna according to FIG. 6 is preferably manufactured by means of printed circuit board (P(CB) technology. The horizontal metal layers, i.e. the middle patch 610, the top patch 640, and preferably also the ground plane 600, are, for example, etched. The vertical conductors 624, 634, 654, 664, 693 can preferably be made by means of vias, i.e. metallized holes. Several hundred antennas can then be manufactured at the same time from a single PCB and then be milled apart. There are several advantages by manufacturing the small stacked patch antenna according to the invention. The patches and the vias can be placed arbitrarily. The size of the antenna can be reduced, both as to height and as to patch area, but not proportionally to the dielectric constant of the PCB as the slots radiate into air. The size of the antenna can be reduced proportionally to an effective dielectric constant, which is somewhere between the dielectric constant of the PCB substrate and that of air.

Figure 7A:
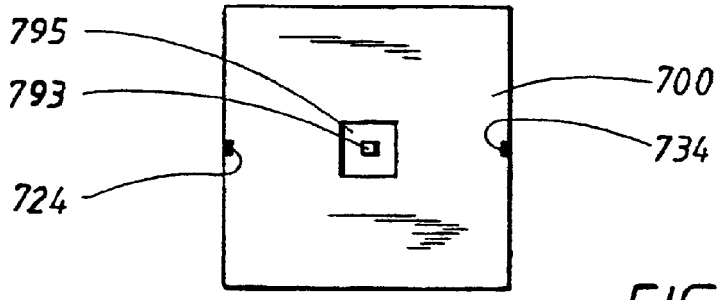
FIGS. 7A–C show the three metallization layers of a small stacked patch antenna according to the invention, for example that shown and described in relation to FIG. 6.
Figure 7B:
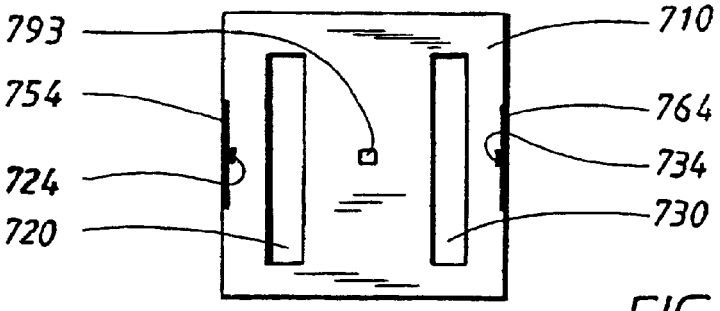
Figure 7C:
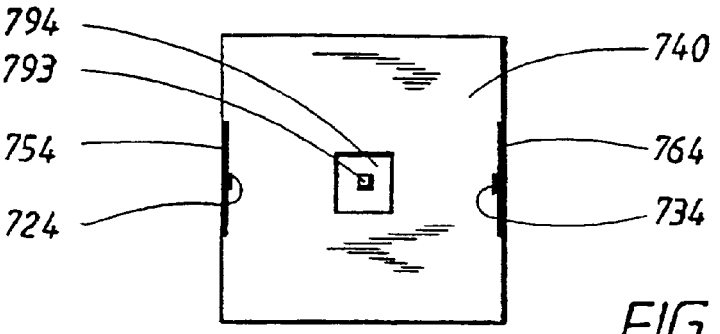

FIGS. 7A to 7C show the three metallization layers of a small stacked patch antenna according to the invention, for example that shown and described in relation to FIG. 6. FIG. 7A shows a ground plane 700. FIG. 7B shows a middle patch 710, which is to be mounted on top of the ground plane 700 with a dielectric in between. The dielectric can preferably be a circuit board, as described above in relation to FIG. 6. FIG. 7C shows a top patch 740, which is to be mounted on top of the of the middle patch 710 with a dielectric in between. FIGS. 7A to 7C further show a first aperture 720, a first via 724 to the ground plane 700, a second aperture 730, a second via 734 to the ground plane 700, a first via 754 to the middle patch 710 from the top patch 740, a second via 764 to the middle patch 710 from the top patch 740, a feed via 793, a top patch opening 794 for the feed via 793, and a ground plane opening 795 for the feed via 793.

To be noted is that FIG. 6 and FIG. 7 illustrate feeds with inductive feed matching by having the feed vias 693, 793 extend all the way to the top patch openings 694, 794 in the layer of the top patches 640, 740. Other vias 624, 634, 724, 734 are also from a cost point of view preferably made through the whole antenna, if possible, as is illustrated in FIG. 6 and FIG. 7.

The basic principle of the invention is to place at least two apertures on a middle patch, to thereby force a current to the edges of the middle patch. In a typical application working in the 5 GHz to 6 GHz range, the dimensions of an antenna structure according to the invention can for the top and middle patch be approximately 12 mm by 12 mm for printed circuit board (PCB) embodiments and 16 mm by 14 mm for metal self supporting embodiments. The metal embodiments will preferably have an approximate distance of 3.5 mm between the middle patch and the top patch, and 1.7 mm between the middle patch and the ground plane. The PCB embodiments will preferably have an approximate distance of 1.6 mm between the middle patch and the top patch, and 1.6 mm between the middle patch and the ground plane, these being the sizes of standard printed circuit boards.

The invention is not restricted to the above described embodiments, but may be varied within the scope of the following claims.

FIG. 1

| | |
|---|---|
| 190 | computer - mobile terminal. |
| 191 | slot for PC-card. |
| 199 | a PC-card onto which or an antenna according to the invention is intended to be mounted or integrated with. |

FIG. 2

| | |
|---|---|
| 200 | ground plane |
| 201 | a preferable minimum ground plane |
| 210 | first or middle patch |

-continued

| | |
|---|---|
| 212 | first patch edge/circumeference |
| 214 | front slot between first patch and ground plane |
| 216 | back slot between first patch and ground plane |
| 219 | feed point/area |
| 220 | first aperture |
| 222 | first aperture edge/circumference |
| 224 | first conductor to ground plane |
| 226 | first zero potential area on first patch |
| 230 | second aperture |
| 232 | second aperture edge/circumference |
| 234 | second conductor to ground plane |
| 236 | second zero potential area on first patch |
| 240 | second or top patch |
| 242 | second patch edge/circumeference |
| 244 | front slot between second patch and first patch |
| 246 | back slot between second patch and first patch |
| 254 | first conductor to first patch |
| 256 | first zero potential area on second patch |
| 264 | second conductor to first patch |
| 266 | second zero potential area on second patch |

FIG. 3

| | |
|---|---|
| 310 | first or middle patch |
| 311 | middle patch strip section |
| 312 | first patch edge/circumeference |
| 315 | front slot position between first patch and ground plane |
| 317 | back slot position between first patch and ground plane |
| 319 | feed point/area |
| 320 | first aperture |
| 322 | first aperture edge/circumference |
| 324 | connection place for a first conductor to a ground plane |
| 326 | first zero potential area on first patch |
| 327 | first path around first aperture |
| 328 | second path around first aperture |
| 330 | second aperture |
| 332 | second aperture edge/circumference |
| 334 | connection place for a second conductor to a ground plane |
| 336 | second zero potential area on first patch |
| 337 | first path around second aperture |
| 338 | second path around second aperture |
| 354 | connection place for a first conductor to a second patch |
| 364 | connection place for a second conductor to a second patch |
| 371 | first symmetry line |
| 375 | second symmetry line |

FIG. 4

| | |
|---|---|
| 400 | ground plane |
| 401 | a preferable minimum ground plane |
| 410 | first or middle patch |
| 419 | feed point/area |
| 420 | first aperture |
| 424 | first conductor to ground plane |
| 430 | second aperture |
| 434 | second conductor to ground plane |
| 454 | first conductor to first patch |
| 464 | second conductor to first patch |
| 481 | part A of second/top patch |
| 482 | part B of second/top patch |
| 483 | division between part A and B of second/top patch |

FIG. 5

| | |
|---|---|
| 510 | first or middle patch |
| 512 | first patch edge/circumference |
| 518 | feed point indentations |
| 519 | feed point/area |
| 520 | first aperture |
| 522 | first aperture edge/circumference |
| 524 | first conductor to ground plane |
| 526 | first zero potential area on first patch |
| 530 | second aperture |
| 532 | second aperture edge/circumference |
| 534 | second conductor to ground plane |
| 536 | second zero potential area on first patch |
| 592 | secondary apertures on the first/middle patch |

FIG. 6

| | |
|---|---|
| 600 | ground plane |
| 610 | first or middle patch |
| 624 | first conductor/via to ground plane |

-continued

| | |
|---|---|
| 634 | second conductor/via to ground plane |
| 640 | second or top patch |
| 654 | first conductor/via to first patch |
| 664 | second conductor/via to first patch |
| 693 | feed via |
| 694 | top patch opening for feed via |
| 696 | first dielectric between top and middle patch |
| 697 | second dielectric between middle patch and ground plane |
| FIG. 7 | |
| 700 | ground plane |
| 710 | first or middle patch |
| 720 | first aperture |
| 724 | first conductor/via to ground plane |
| 730 | second aperture |
| 734 | second conductor/via to ground plane |
| 740 | second or top patch |
| 754 | first conductor/via to first patch |
| 764 | second conductor/via to first patch |
| 793 | feed via |
| 794 | top patch opening for feed via |
| 795 | ground plane opening for feed via |

What is claimed is:

1. A low-profile monopole antenna structure having a linear polarization, comprising:

a first metallic patch and a second metallic patch stacked over a ground plane, the first patch comprising a circumference along a patch edge of the first patch, the second patch comprising a circumference along a patch edge of the second patch, the first patch being arranged between the ground plane and the second patch, the first patch being grounded at at least a first zero potential area by electrical connection with the ground plane and a second zero potential area by electrical connection with the ground plane, and has been inserted after "and" second being fed at a single feed area, the second patch being electrically interconnected to the first patch, and the first patch comprises at least a first aperture and a second aperture located completely within the circumference of the first patch to thereby force currents, propagating from the feed area to the first zero potential area and the second zero potential area, toward the patch edge of the first patch to thereby enable radiation from slots defined by the edge of the first patch and the edge of the second patch and the ground plane.

2. A device comprising wireless communication means, wherein the device comprises an antenna according to claim 1.

3. A wireless mobile terminal, wherein the terminal comprises an antenna according to claim 1 for wireless communication.

4. A personal computer card suitable for insertion into an electronic device, wherein the card comprises an antenna according to claim 1.

5. A wireless local area network system comprising a base station and a plurality of terminals which are in wireless communication with the base station, wherein at least one terminal comprises either directly or indirectly an antenna according to claim 1.

6. The antenna structure in claim 1, wherein the current propagating from the feed area moves in essentially one direction toward the patch edge.

7. A linearly-polarized, low-profile, monopole antenna structure, comprising:

a first metallic patch and a second metallic patch stacked over the first patch, the patches being intended to be mounted over a ground plane, the first patch comprising a circumference along a patch edge of the first patch, the second patch comprising a circumference along a patch edge of the second patch, the first patch being arranged between the ground plane and the second patch, the first patch comprising a first zero potential area by connection with the ground plane and a second zero potential area by connection with the ground plane, the second patch being electrically interconnected to the first patch, and the linearly-polarized monopole antenna being fed at a single feed area comprised on the first patch, and the first patch comprises at least a first aperture and a second aperture located completely within the circumference of the first patch to thereby force current, propagating from the feed area to the first zero potential area and the second zero potential area, toward the patch edge of the first patch to thereby enable radiation from slots defined by the edge of the first patch and the edge of the second patch and the ground plane.

8. The antenna structure according to claim 7, wherein the first aperture and the second aperture are located on the first patch in such a way that current propagating from the feed area to the first zero potential area propagates in two different paths around the first aperture and that current propagating from the feed area to the second zero potential area propagates in two different paths around the second aperture.

9. The antenna structure according to claim 7, wherein the first aperture is located between the feed area and the first zero potential area, and in that the second aperture is located between the feed area and the second zero potential area.

10. The antenna structure according to claim 7, wherein the second patch is electrically interconnected to the first patch at at least the first zero potential area and the second zero potential area.

11. The antenna structure according to claim 7, wherein the first aperture and the second aperture each have an extension which is substantially perpendicular to a line between the first zero potential area and the second zero potential area.

12. The antenna structure according to claim 7, wherein there is a symmetry of the first patch about a line between the first zero potential area and the second zero potential area.

13. The antenna structure according to claim 7, wherein there is a symmetry of the first patch about a line perpendicular to a line between the first zero potential area and the second zero potential area.

14. The antenna structure according to claim 7, wherein the second patch comprises no openings within its circumference.

15. The antenna structure according to claim 7, wherein the second patch comprises at least one opening within its circumference.

16. The antenna structure according to claim 7, wherein the second patch is electrically split into two halves along a line which is substantially perpendicular to a line between the first zero potential area and the second zero potential area.

17. The antenna structure according to claim 7, wherein the second patch at least covers the first aperture and the second aperture of the first patch.

18. The antenna structure according to claim 7, wherein the first patch comprises further apertures.

19. The antenna structure according to claim 7, wherein the first patch and the second patch are substantially of the same size.

20. The antenna structure according to claim 7, wherein the first patch, in addition to the first aperture and the second aperture, comprises further apertures.

21. The antenna structure according to claim 7, wherein the antenna structure comprises the ground plane.

22. The antenna structure according to claim 21, wherein the ground plane is substantially of the same size as the first patch and the second patch.

23. The antenna structure according to claim 21, wherein the first patch is supported by a first dielectric and in that the second patch is between the first dielectric and a second dielectric and in that the ground plane is supported by the second dielectric, the first dielectric and the second dielectric further providing the antenna with mechanical support giving the antenna a self supporting structure.

24. The antenna structure according to claim 7, wherein the electrical connections from the first patch to the ground plane and the electrical interconnections between the first patch and the second patch, in addition to providing the antenna structure with electrical connections also provides the antenna with mechanical support giving the antenna a self supporting structure.

25. The antenna structure according to claim 7, wherein the first patch is supported by a first dielectric and in that the second patch is supported by a second dielectric, the first dielectric and the second dielectric further providing the antenna with mechanical support giving the antenna a self supporting structure.

26. The antenna structure according to claim 7, wherein the single feed area is probe fed at one point.

27. The antenna structure according to claim 26, wherein the single feed area further comprises inductive feed matching.

28. The antenna structure according to claim 7, wherein the single feed area is probe fed at a plurality of points.

29. The antenna structure according to claim 28, wherein the plurality of points are placed in the feed area along a limited line that if extended would pass through the first zero potential area and the second zero potential area.

30. The antenna structure according to claim 28, wherein the plurality of points are placed in the feed area symmetrically about a line that passes through the first zero potential area and the second zero potential area.

31. The antenna structure according to claim 7, wherein the single feed area is fed by an aperture coupling.

32. The antenna structure in claim 7, wherein the current propagating from the feed area moves in essentially one direction toward the patch edge.

* * * * *